US011712599B2

(12) United States Patent
Lin

(10) Patent No.: US 11,712,599 B2
(45) Date of Patent: Aug. 1, 2023

(54) SLIDE STRUCTURE OF EXERCISE MACHINE

(71) Applicant: Tsung-Chou Lin, Tainan (TW)

(72) Inventor: Tsung-Chou Lin, Tainan (TW)

(73) Assignee: Chih-Yung Hsu, Tainan (TW)

( * ) Notice: Subject to any disclaimer, the term of this patent is extended or adjusted under 35 U.S.C. 154(b) by 0 days.

(21) Appl. No.: 17/457,999

(22) Filed: Dec. 7, 2021

(65) Prior Publication Data

US 2022/0193486 A1 Jun. 23, 2022

(30) Foreign Application Priority Data

Dec. 23, 2020 (TW) ..... 109217014

(51) Int. Cl.
*A63B 22/00* (2006.01)
*A63B 22/20* (2006.01)

(52) U.S. Cl.
CPC ..... *A63B 22/0087* (2013.01); *A63B 22/203* (2013.01)

(58) Field of Classification Search
CPC ..... A63B 71/0054; A63B 2071/009; A63B 21/4031; A63B 21/4035; A63B 21/00061; A63B 21/02; A63B 21/023; A63B 21/0428; A63B 21/151; A63B 21/154; A63B 23/0222; A63B 2208/0219; A63B 22/0087; A63B 22/203; A63B 22/0076; A63B 2022/0079; A63B 22/20
See application file for complete search history.

(56) References Cited

U.S. PATENT DOCUMENTS 199,432 A * 1/1878 Goldie ..... A63B 22/0076 482/114
6,926,646 B1 * 8/2005 Nguyen ..... A63B 22/208 48/51
10,449,410 B2 * 10/2019 Hamilton ..... A63B 21/008
10,471,297 B1 * 11/2019 Smith ..... A63B 24/0087
2003/0166438 A1 * 9/2003 Gramaccioni ..... A63B 26/003 482/72
2010/0144496 A1 * 6/2010 Schmidt ..... A63B 23/12 482/70
2014/0031175 A1 * 1/2014 Peralo ..... A63B 21/4045 482/66
2015/0202484 A1 * 7/2015 Lalaoua ..... A63B 23/0211 482/130
2018/0056117 A1 * 3/2018 Hamilton ..... A63B 69/06

FOREIGN PATENT DOCUMENTS

TW M616663 U * 9/2020

* cited by examiner

*Primary Examiner* — Garrett K Atkinson
(74) *Attorney, Agent, or Firm* — Rosenberg, Klein & Lee

(57) ABSTRACT

A slide structure of an exercise machine comprises a slide seat, configured to be movable along an axial direction relative to a slide rail; a roller, rotatably coupled to the slide seat; a dry-running limit slider, having a bushing seat and a dry-running bushing, the dry-running bushing embracing the slide rail on a vertical plane perpendicular to the axial direction. The slide seat moves on the slide rail along the axial direction through the roller to roll along the axial direction, the dry-running limit slider to slide along the axial direction, and the dry-running limit slider to limit the displacement of the slide seat on the vertical plane.

10 Claims, 12 Drawing Sheets

SLIDE STRUCTURE OF EXERCISE MACHINE

FIELD OF THE INVENTION

The present invention relates to an exercise machine, and more particularly to a slide structure of an exercise machine.

BACKGROUND OF THE INVENTION

Exercise machines are often equipped with linear slide elements, such as linear slide seats, linear slide counterweights, linear slide grips, and so on. Taking a rowing machine as an example, the seat of the rowing machine can slide forward or backward through slide rails, thereby simulating rowing actions. Some linear slide elements of rowing machines use rollers to roll in recessed rails.

However, it is easy for foreign objects to fall into the recessed rail, which may damage the rollers and reduce the service life of the rollers. The foreign objects in the recessed rail may cause the rollers to bounce and make a noise when rolling, and affect the smoothness of the rollers and the comfort during the operation of the exercise machine.

SUMMARY OF THE INVENTION

In order to solve the above-mentioned shortcomings, the present invention provides a slide structure of an exercise machine for sliding on a slide rail of the exercise machine. The slide rail is disposed on a rail seat of the exercise machine through a connecting portion. The slide rail extends along an axial direction. The slide structure of the exercise machine comprises a slide seat, a roller, and a dry-running limit slider. The slide seat is configured to be movable along the axial direction relative to the slide rail. The roller is rotatably coupled to the slide seat. The roller rolls on the slide rail along the axial direction. The dry-running limit slider includes a bushing seat and a dry-running bushing. The bushing seat is coupled to the slide seat. The dry-running bushing is fixed to the bushing seat. The dry-running bushing embraces the slide rail on a vertical plane perpendicular to the axial direction to limit displacement of the slide seat on the vertical plane. The dry-running limit slider slides on the slide rail along the axial direction. The slide seat moves on the slide rail along the axial direction through the roller to roll along the axial direction, the dry-running limit slider to slide along the axial direction, and the dry-running limit slider to limit the displacement of the slide seat on the vertical plane.

Wherein, the roller includes a plurality of rollers each rolling on the slide rail.

Wherein, in the axial direction, the dry-running limit slider is located between the rollers.

Wherein, the slide rail includes a plurality of slide rails, and the rollers roll on each of the slide rails, respectively.

Wherein, the dry-running limit slider includes a plurality of dry-running limit sliders each sliding on the slide rail.

Wherein, in the axial direction, the roller is located between the dry-running limit sliders.

Wherein, the slide rail includes a plurality of slide rails, and the dry-running limit sliders slide on each of the slide rails, respectively.

Wherein, on the vertical plane, a contact cross-section of the roller and the slide rail is in the shape of one of an arc, a reverse V and a truncated cone.

Furthermore, the bushing seat has a groove extending along the axial direction and a notch communicating with the groove. The dry-running bushing has a dry-running bushing notch corresponding to the notch and extending along the axial direction. On the vertical plane, the connecting portion is located in the notch and the dry-running bushing notch. The dry-running bushing is located in the groove.

Furthermore, the bushing seat has an annular groove communicating with the groove on the vertical plane. An engaging groove is disposed in the annular groove and extends away from the notch. An outer wall of the dry-running bushing is provided with a plurality of blocks arranged annularly and corresponding to the annular groove. One of the blocks has an engaging protrusion engaged in the engaging groove.

The present invention further provides a slide structure of an exercise machine for sliding on a slide rail of the exercise machine. The slide rail is disposed on a rail seat of the exercise machine through a connecting portion. The slide rail extends along an axial direction. The slide structure of the exercise machine comprises a slide seat and a dry-running limit slider. The slide seat is configured to be movable along the axial direction relative to the slide rail. The dry-running limit slider includes a bushing seat and a dry-running bushing. The bushing seat is coupled to the slide seat. The dry-running bushing is fixed to the bushing seat. The dry-running bushing embraces the slide rail on a vertical plane perpendicular to the axial direction to limit displacement of the slide seat on the vertical plane. The dry-running limit slider slides on the slide rail along the axial direction. The slide seat moves on the slide rail along the axial direction through the dry-running limit slider to slide along the axial direction and the dry-running limit slider to limit the displacement of the slide seat on the vertical plane.

According to the above technical features, the following effects can be achieved:

1. The slide rail is not a recessed slide rail, so it will not contain foreign objects. The roller rolls on the slide rail along the axial direction smoothly. In addition, through the dry-running limit slider to embrace the slide rail and slide on the slide rail along the axial direction, the dry-running limit slider also limits the displacement of the slide seat on the vertical plane effectively, so that the slide seat moves on the slide rail more stably and smoothly.

2. Taking a rowing machine as an example, the weight of the user will act on the slide rail through the slide seat. The slide seat of the present invention slides on the slide rail by means of the roller and the dry-running limit slider, so the dry-running limit slider reduces the force exerted by the roller on the slide rail greatly, so as to reduce the working load of the roller and prolong the service life of the roller effectively.

3. The contact cross-section of the roller and the slide rail may be in the shape of one of an arc, a reverse V and a truncated cone, so that the roller can roll on the slide rail smoothly.

4. With the annular groove and the engaging groove of the bushing seat as well as the blocks arranged annularly and the engaging protrusion of the dry-running bushing, the dry-running bushing is coupled to the bushing seat more firmly. There will be no relative translation along the axial direction and no relative rotation along the vertical plane between the dry-running bushing and the bushing seat.

DESCRIPTION OF THE PREFERRED EMBODIMENTS

Embodiments of the present invention will now be described, by way of example only, with reference to the accompanying drawings.

Figure 1:
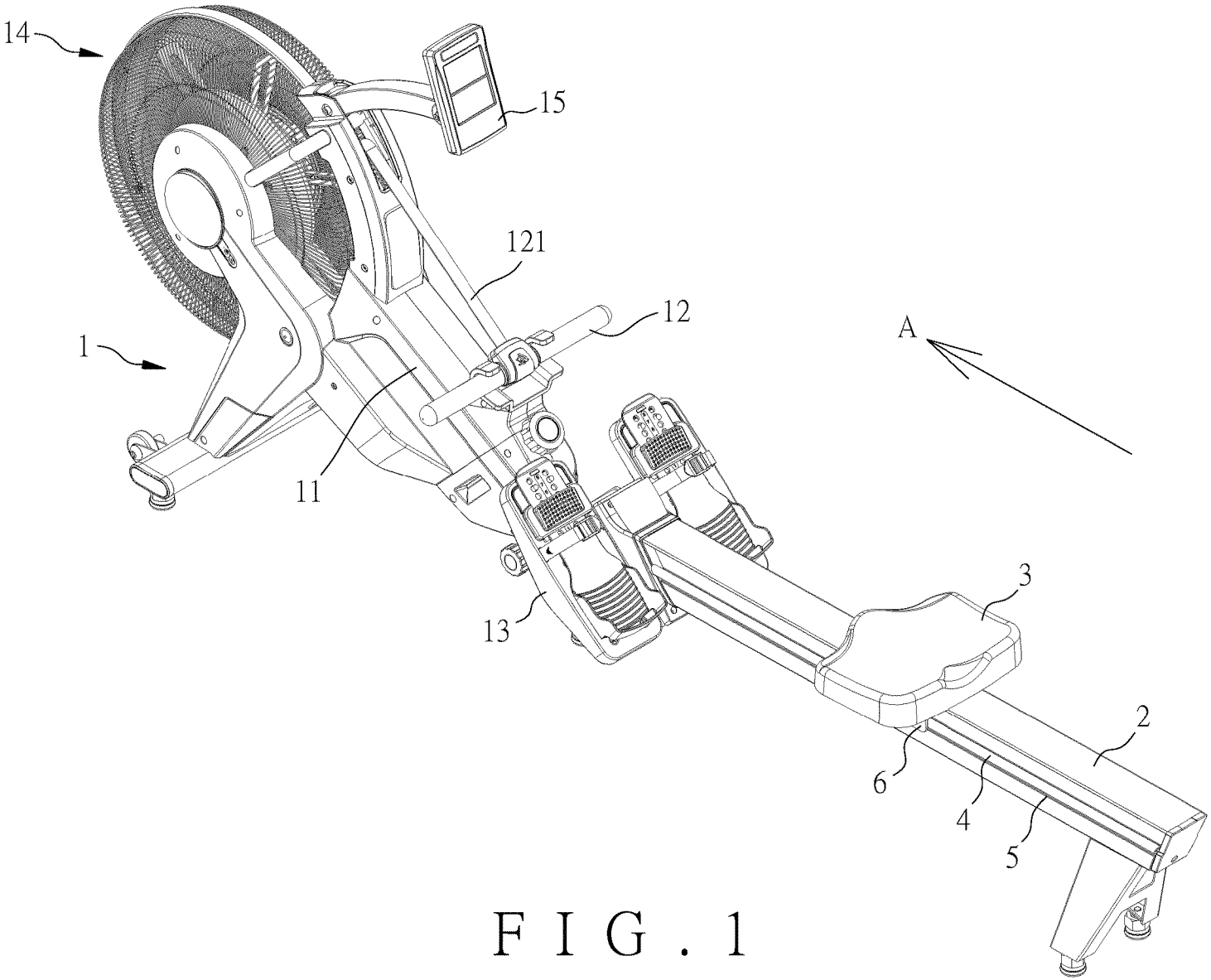
FIG. 1 is a schematic view of the present invention applied to an exercise machine, wherein the exercise machine is a rowing machine.
Figure 2:
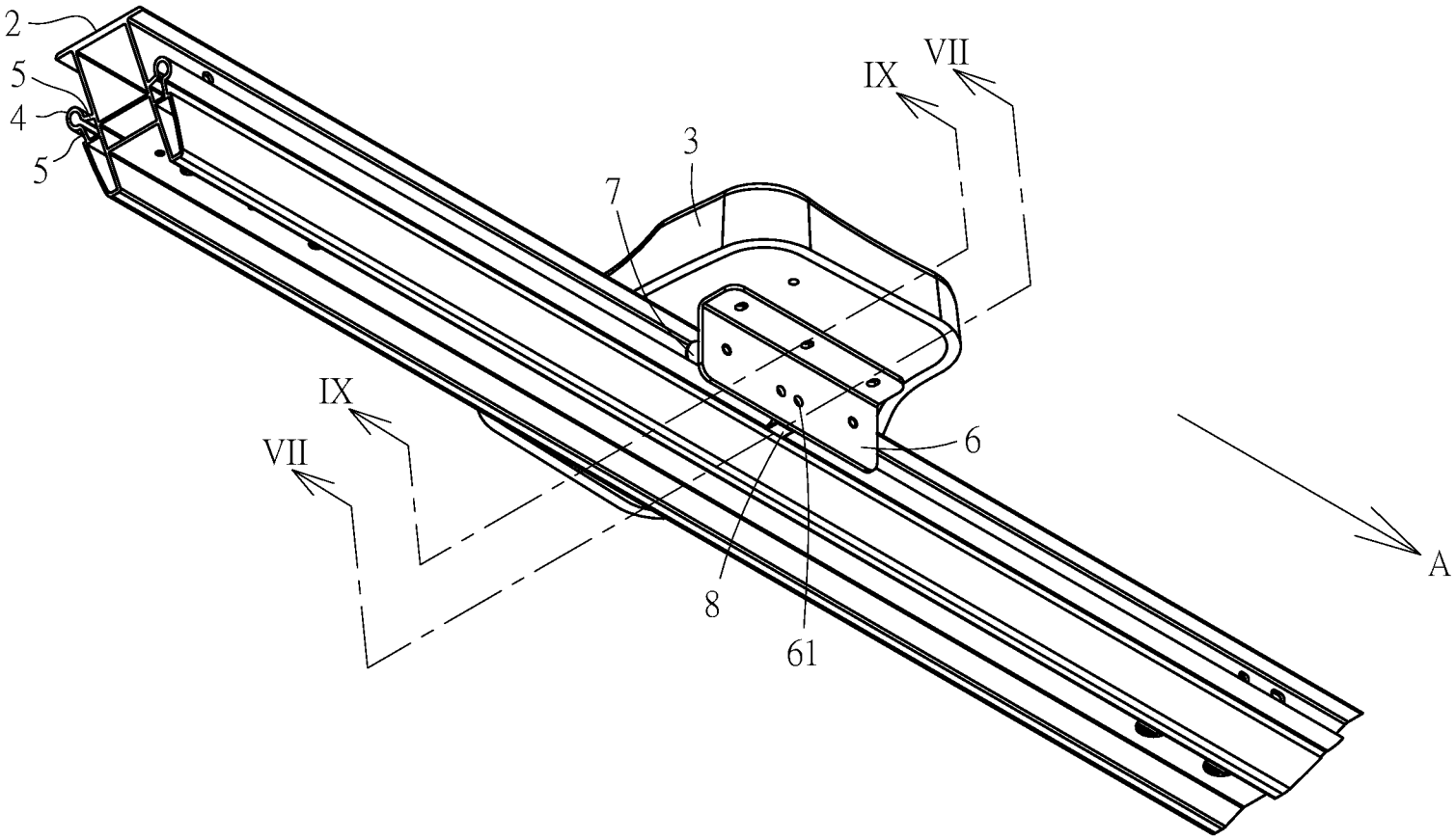
FIG. 2 is a schematic view of a slide structure coupled to a slide rail according to a first embodiment of the present invention.

FIG. 1 and FIG. 2 illustrate a first embodiment of the present invention applied to an exercise machine. The exercise machine includes an operating unit 1, a rail seat 2, a seat 3, two slide rails 4, two connecting portions 5, and a slide structure of the present invention. The exercise machine takes a rowing machine as an example. In actual implementation, the slide structure may be applied to any other exercise machine having a linear slide rail structure, such as a leg curl machine.

The operating unit 1 includes a base 11, a handle 12, two pedals 13, a resistance member 14, and a control member 15. The handle 12 is stretchable and disposed on the base 11. The handle 12 is connected to the resistance member 14 through a cable 121. The pedals 13 are secured to the left and right sides of the base 11, respectively. The resistance member 14 is pivotally connected to the base 11. The resistance member 14 may be a wind resistance member, magnetic resistance member, etc., but not limited thereto. The control member 15 is disposed on the base 11 and is in signal communication with the resistance member 14.

The rail seat 2 is connected to the base 11. The slide rails 4 are disposed on the left and right sides of the rail seat 2 through the connecting portions 5, respectively. The rail seat 2, the slide rails 4 and the connecting portions 5 all extend along an axial direction A. In the following description, two sides of the horizontal plane along the axial direction A are defined as left and right sides.

Figure 3:
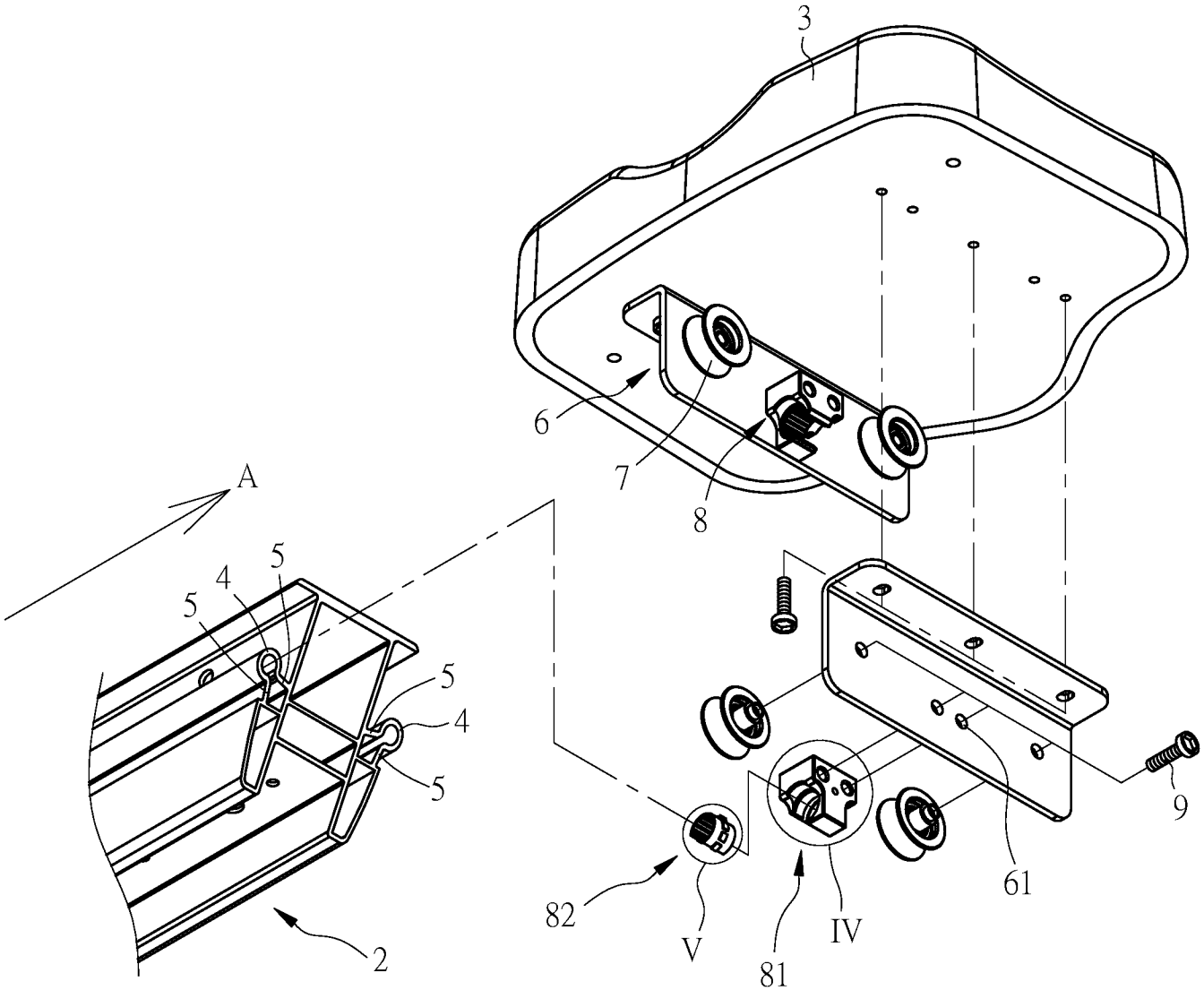
FIG. 3 is an exploded view of the slide structure and the slide rail according to the first embodiment of the present invention.

Referring to FIGS. 1-3, the slide structure is coupled to the slide rails 4. The slide structure includes a slide seat 6, four rollers 7, and two dry-running limit sliders 8.

In this embodiment, the slide seat 6 includes two platy bodies connected to two sides of the bottom of the seat 3. The slide seat 6 and the seat 3 straddle the slide rails 4 together. The slide seat 6 is movable relative to the slide rails 4 to move along the axial direction A on the slide rails 4. The slide seat 6 has a plurality of screw holes 61.

The rollers 7 are rotatably connected to the inner surfaces of the left and right sides of the slide seat 6. The rollers 7 roll on the slide rails 4 on the left and right sides of the rail seat 2 along the axial direction A, respectively.

The dry-running limit sliders 8 are connected to the inner surfaces of the left and right sides of the slide seat 6. The dry-running limit sliders 8 slide on the slide rails 4 on the left and right sides of the rail seat 2 along the axial direction A, respectively.

In actual implementation, the rollers 7 may not be installed, so the slide seat 6 moves on the slide rails 4 through the dry-running limit sliders 8.

Figure 4:
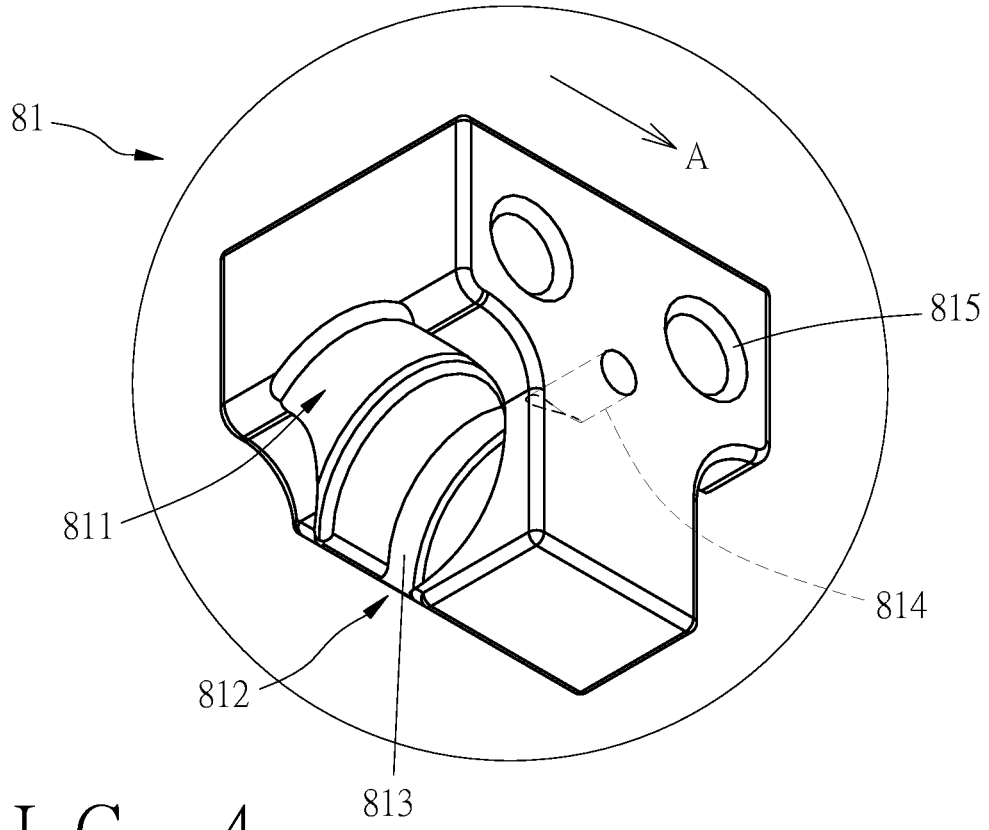
FIG. 4 is a partial enlarged view of a bushing seat according to the first embodiment of the present invention.
Figure 5:
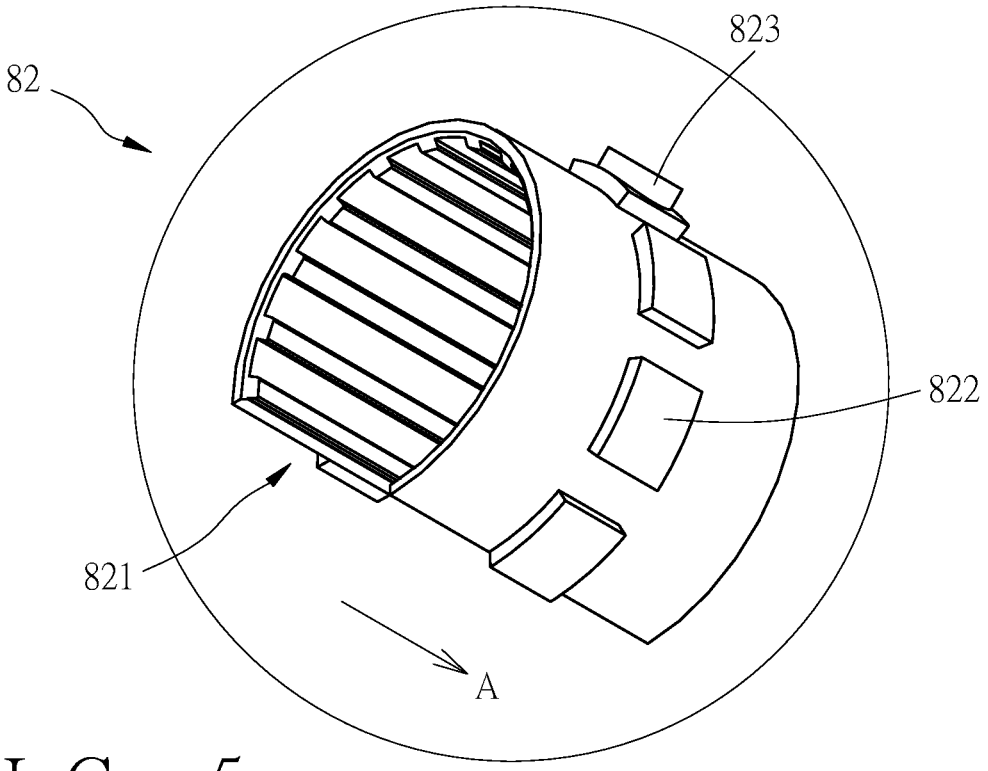
FIG. 5 is a partial enlarged view of a dry-running bushing according to the first embodiment of the present invention.

Referring to FIGS. 3-5, each dry-running limit slider 8 has a bushing seat 81 and a dry-running bushing 82. The dry-running bushing 82 is fixed to the bushing seat 81. The bushing seat 81 is fixed to the inner surfaces of the left and right sides of the slide seat 6.

The bushing seat 81 has a groove 811 extending along the axial direction A and a notch 812 communicating with the groove 811. The bushing seat 81 has an annular groove 813 on a vertical plane perpendicular to the axial direction A to communicate with the groove 811. An engaging groove 814 is provided in the annular groove 813 and extends away from the notch 812. The bushing seat 81 further has two through holes 815.

The dry-running bushing 82 has a dry-running bushing notch 821 corresponding to the notch 812 and extending along the axial direction A. The outer wall of the dry-running bushing 82 is provided with a plurality of blocks 822 arranged annularly. One of the blocks 822 has an engaging protrusion 823.

Figure 6:
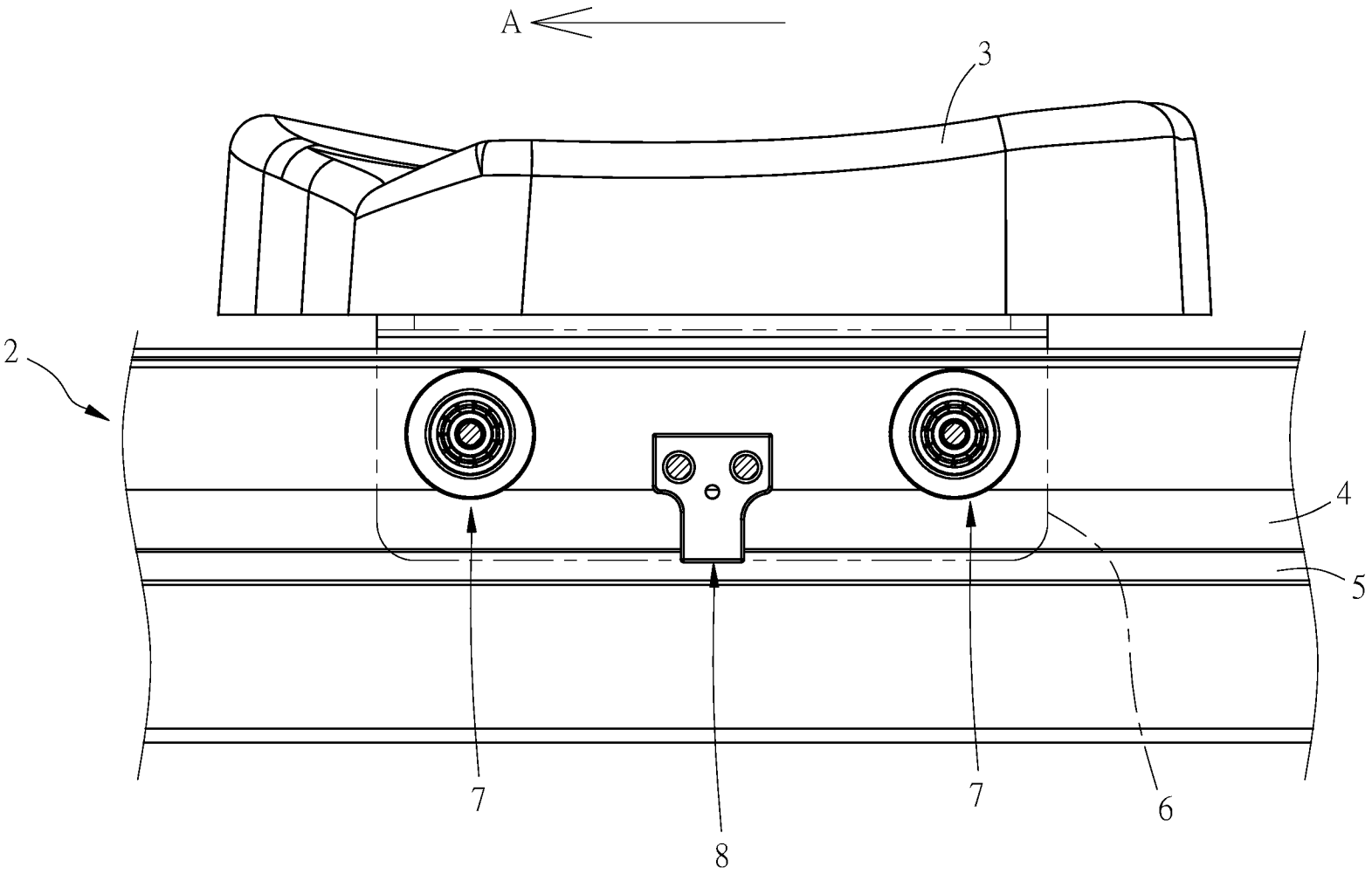
FIG. 6 is a side view of the first embodiment of the present invention.

Please refer to FIG. 6. In this embodiment, each of the left and right sides of the slide seat 6 is provided with two rollers 7 and one dry-running limit slider 8. The dry-running limit slider 8 is located between the two rollers 7. FIG. 6 is a left side view of the present invention, showing the spatial relationship among the roller 7 on the left, the dry-running limit slider 8 on the left and the slide seat 6 on the left.

Figure 7:
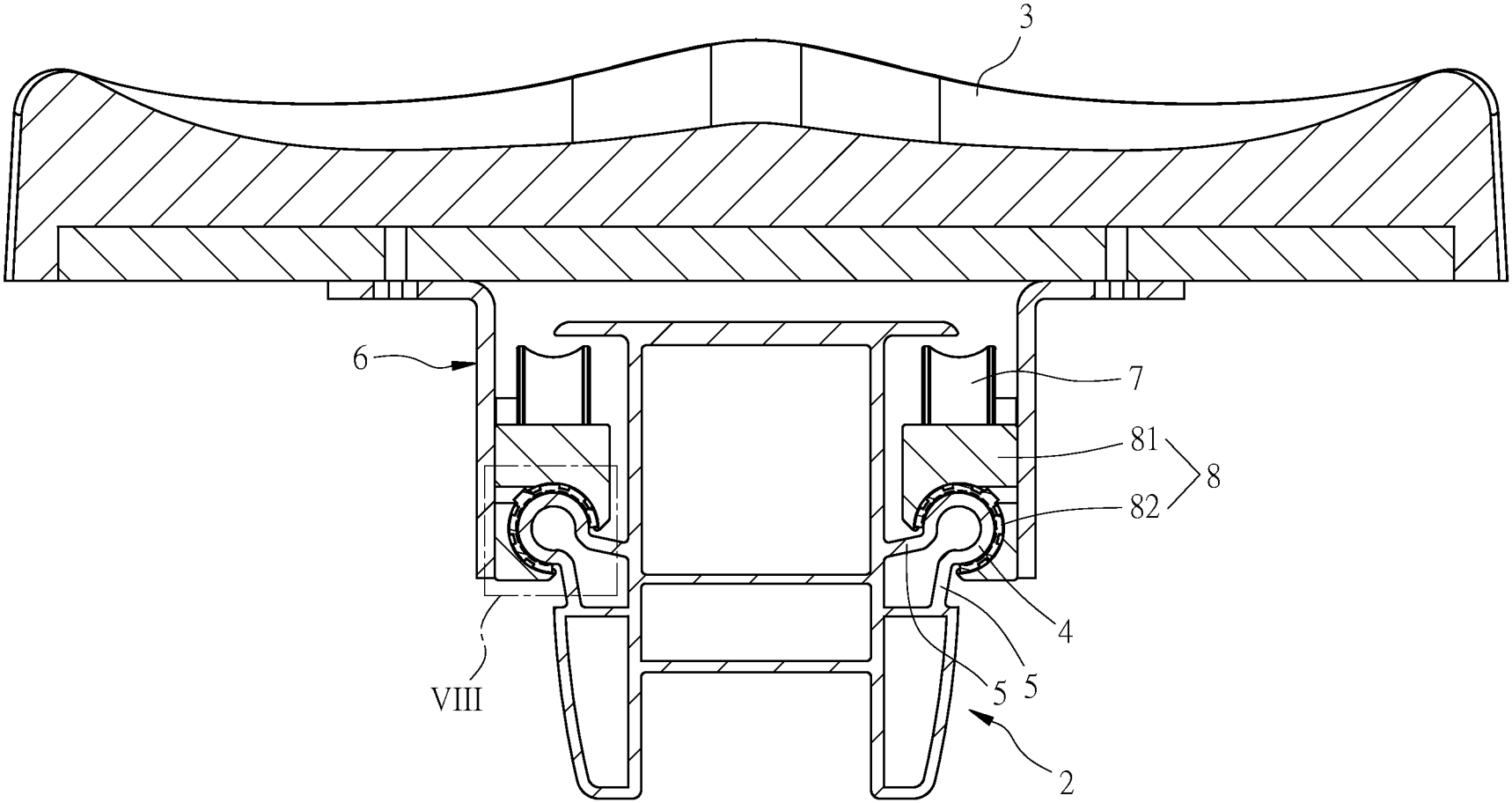
FIG. 7 is a first cross-sectional view of the first embodiment of the present invention.
Figure 8:
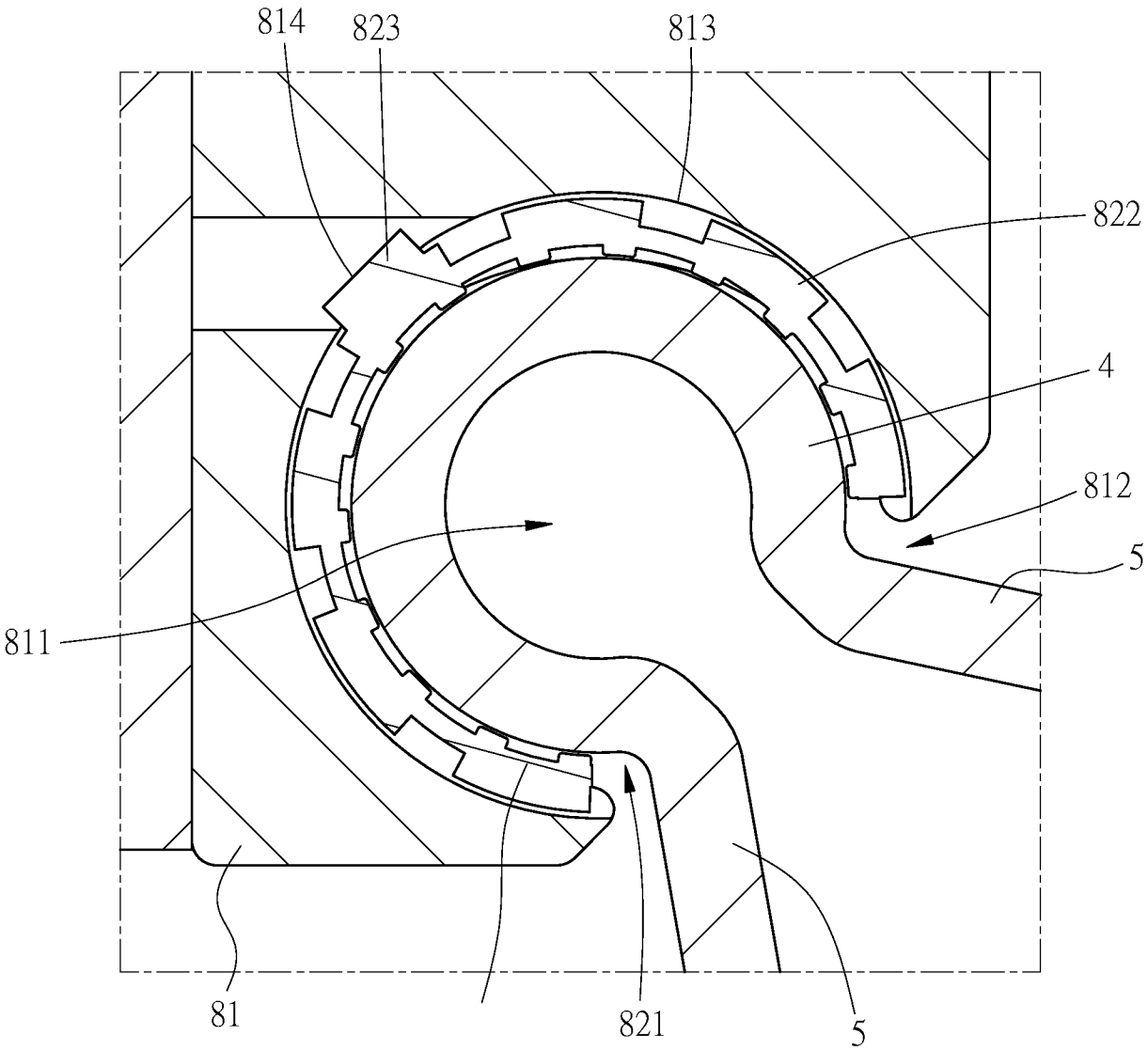
FIG. 8 is a partial enlarged cross-sectional view of the first embodiment of the present invention.

Please refer to FIG. 7 and FIG. 8 in cooperation with FIG. 4 and FIG. 5. When the slide structure is to be coupled to the slide rail 4, the dry-running bushing 82 is first inserted in the bushing seat 81 along the axial direction A, and the dry-running bushing 82 is moved along the axial direction A so that the blocks 822 arranged annularly on the dry-running bushing 82 are correspondingly engaged in the annular groove 813 of the bushing seat 81. Then, the dry-running bushing 82 is rotated along the vertical plane, so that the engaging protrusion 823 on the dry-running bushing 82 is correspondingly engaged in the engaging groove 814 of the bushing seat 81. With the annular groove 813 and the engaging groove 814 of the bushing seat 81 as well as the blocks 822 and the engaging protrusion 823 on the dry-running bushing 82, the dry-running bushing 82 can be coupled to the bushing seat 81 more firmly. There will be no relative translation along the axial direction A and no relative rotation along the vertical plane between the dry-running bushing 82 and the bushing seat 81.

Figure 9:
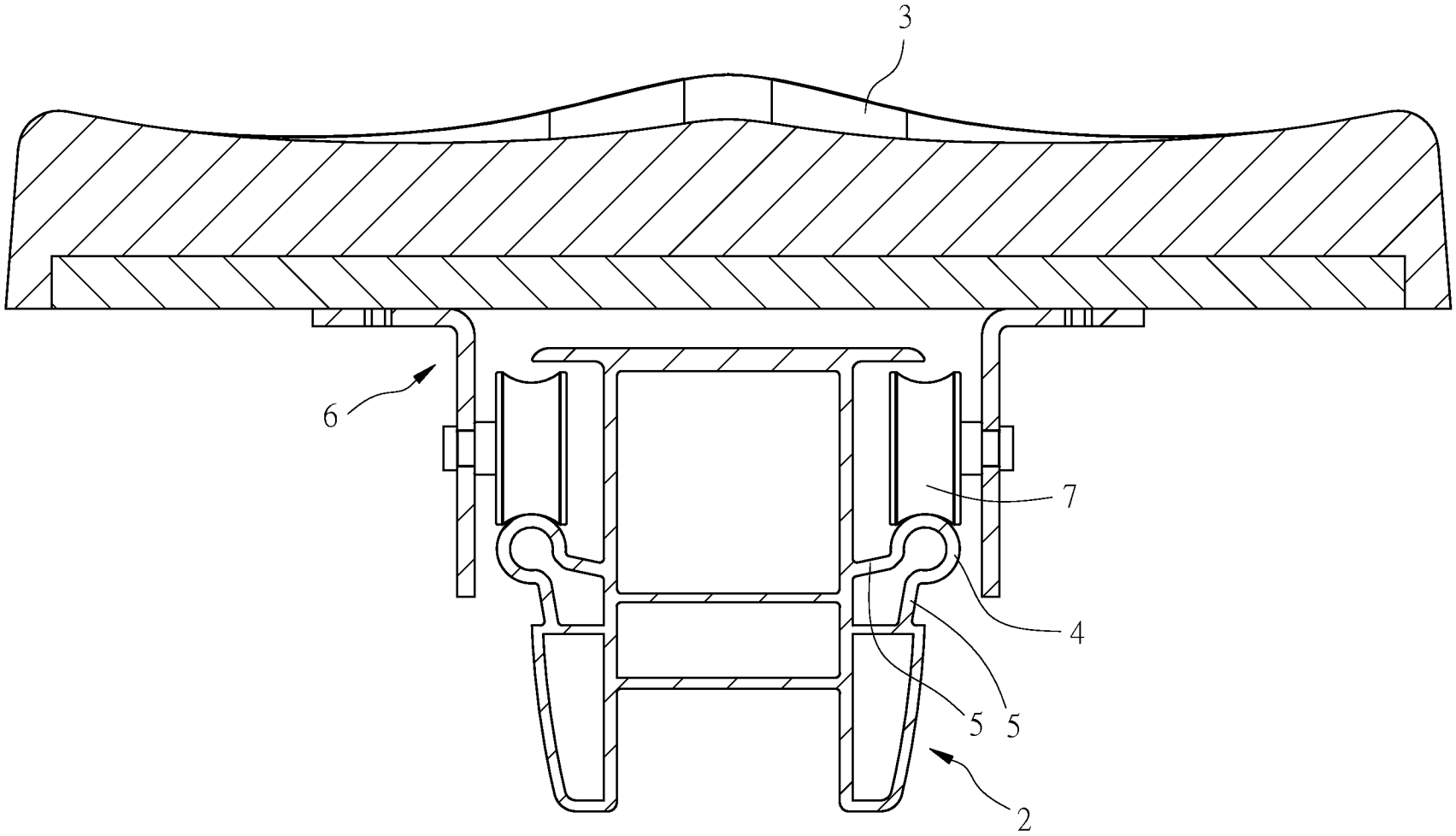
FIG. 9 is a second cross-sectional view of the first embodiment of the present invention.

Please refer to FIG. 7 and FIG. 9 in cooperation with FIG. 3 and FIG. 4. After the dry-running bushing 82 is secured to the bushing seat 81, the through hole 815 of the bushing seat 81 is aligned with the screw hole 61 of the slide seat 6. A screw 9 is inserted through the through hole 815 and the screw hole 61 to fix the dry-running limit slider 8 to the slide seat 6, and the roller 7 is connected to the slide seat 6 by the screw 9.

Please refer to FIG. 7 and FIG. 9 in cooperation with FIG. 4 and FIG. 5. Then, the slide seat 6 is sleeved along the axial direction A from one end of the slide rail 4. In actual implementation, both ends of the slide rail 4*a* in the axial direction A may be provided with a detachable first limit block and a detachable second limit block (not shown). When the first limit block and the second limit block are removed, the slide seat 6 is sleeved on the slide rail 4, or, after the slide seat 6 is sleeved, the first limit block and the second limit block are set. This is to ensure that the slide seat 6 is sleeved on the slide rail 4 smoothly. After being sleeved on the slide rail 4, the slide seat 6 will not move excessively to fall out of the slide rail 4.

After the slide seat 6 is sleeved on the slide rail 4, the slide rail 4 and the dry-running bushing 82 are located in the groove 811 on the vertical plane. The connecting portion 5 is located in the notch 812 and the dry-running bushing notch 821, which can prevent the dry-running limit slider 8 from jamming the connecting portion 5 when sliding and can enable the slide seat 6 to move smoothly. The dry-running bushing 82 embraces the slide rail 4 on the vertical plane, and the roller 7 is in contact with the slide rail 4. On the vertical plane, the contact cross-section of the roller 7 and the slide rail 4 may be in the shape of one of an arc, a reverse V and a truncated cone, so that the roller 7 can roll on the slide rail 4 smoothly.

Referring to FIG. 1, when the user wants to use the exercise machine, he/she sits on the seat 3, steps on the pedals 13 with both feet and pulls the handle 12 of the operating unit 1 with both hands, so that the cable 121 pulls the resistance member 14 to rotate. When the legs are gradually straightened at the same time, the seat 3 drives the slide seat 6 to move on the slide rail 4 away from the resistance member 14. When the legs are gradually curled at the same time, the seat 3 drives the slide seat 6 to move on the slide rail 4 to approach the resistance member 14, and the handle 12 and the cable 121 are returned. This simulates the rowing action, achieving the training effect. The user can adjust the magnitude of the resistance through the control member 15. When the resistance is increased, the user needs to exert greater force with both hands and straighten both legs hard to pull the cable 121 through the handle 12, thereby increasing the training intensity. When the resistance is reduced, the user exerts less force with both hands and straightens both legs with ease, thereby reducing the training intensity. The structure in which the handle 12 rotates the resistance member 14 through the cable 121 belongs to the prior art, and will not be repeated herein.

Referring to FIG. 1 and FIG. 3, during the movement of the slide seat 6 on the slide rail 4, the slide seat 6 moves on the slide rail 4 along the axial direction A through the roller 7 to roll along the axial direction A, the dry-running limit slider 8 to slide along the axial direction A, and the dry-running limit slider 8 to limit the displacement of the slide seat 6 on the vertical plane. In addition, because there is no space between the dry-running bushing 82 and the slide rail 4 and there is no space for foreign objects between the roller 7 and the slide rail 4, so no foreign objects will fall between the slide seat 6 and the slide rail 4. When the slide seat 6 moves, the dry-running bushing 82 limits the displacement of the slide seat 6 on the vertical plane effectively, so that the slide seat 6 moves on the slide rail 4 along the axial direction A more stably and smoothly.

Figure 10:
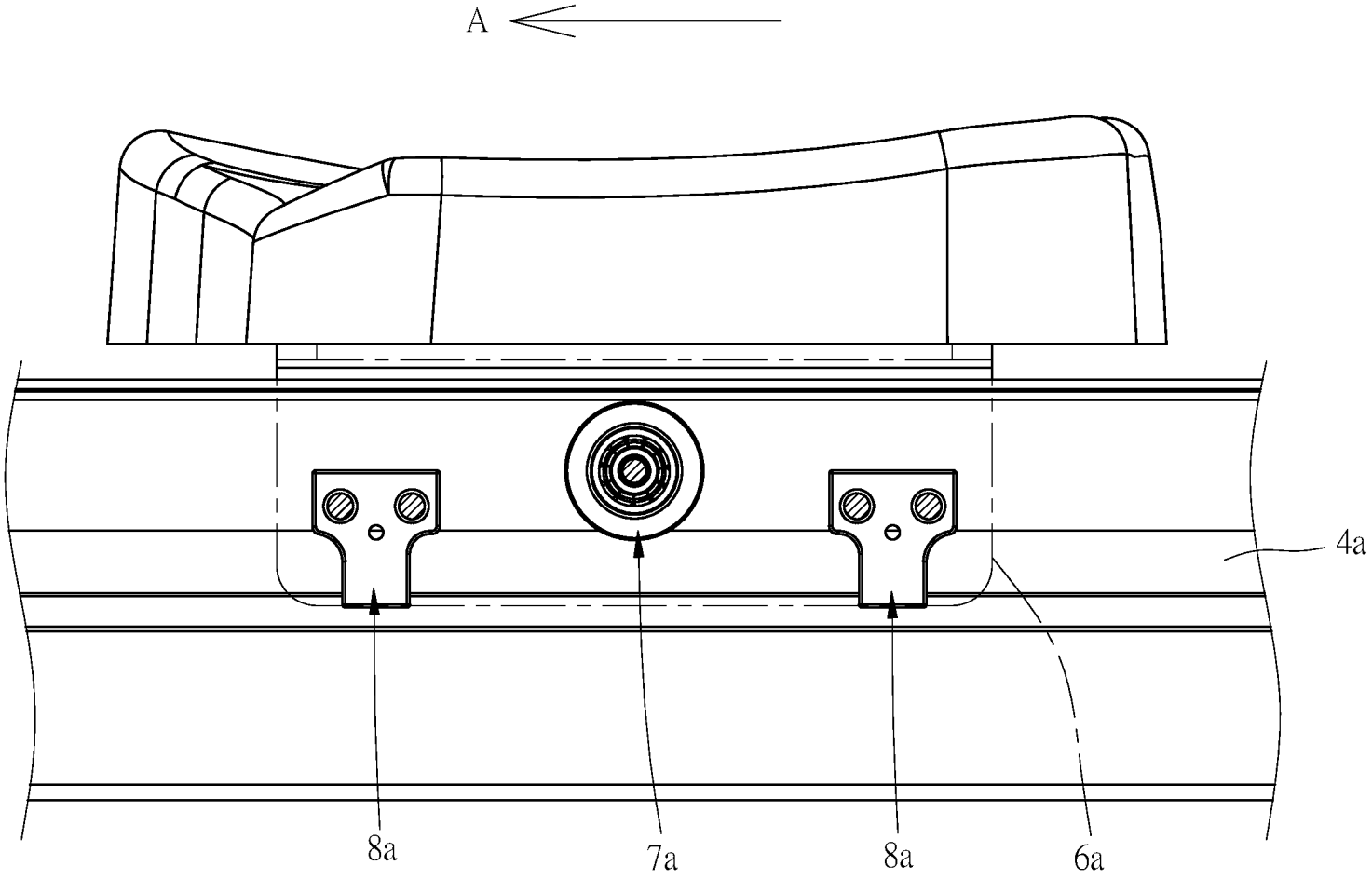
FIG. 10 is a side view of a second embodiment of the present invention.

FIG. 10 illustrates a second embodiment of the present invention. In the first embodiment as shown in FIG. 6, the dry-running limit slider 8 is located between the rollers 7. The second embodiment, viewed from the left side of the slide seat 6*a*, includes two dry-running limit sliders 8*a* and one roller 7*a*. The roller 7*a* is located between the dry-running limit slider 8*a*.

Similar to the first embodiment, in the second embodiment, the slide seat 6*a* moves on the slide rail 4*a* along the axial direction A smoothly. The other structures and functions are the same as those of the first embodiment, so they are not repeated hereinafter, and the rest of the structure of the exercise machine is not shown in the drawings.

Figure 11:
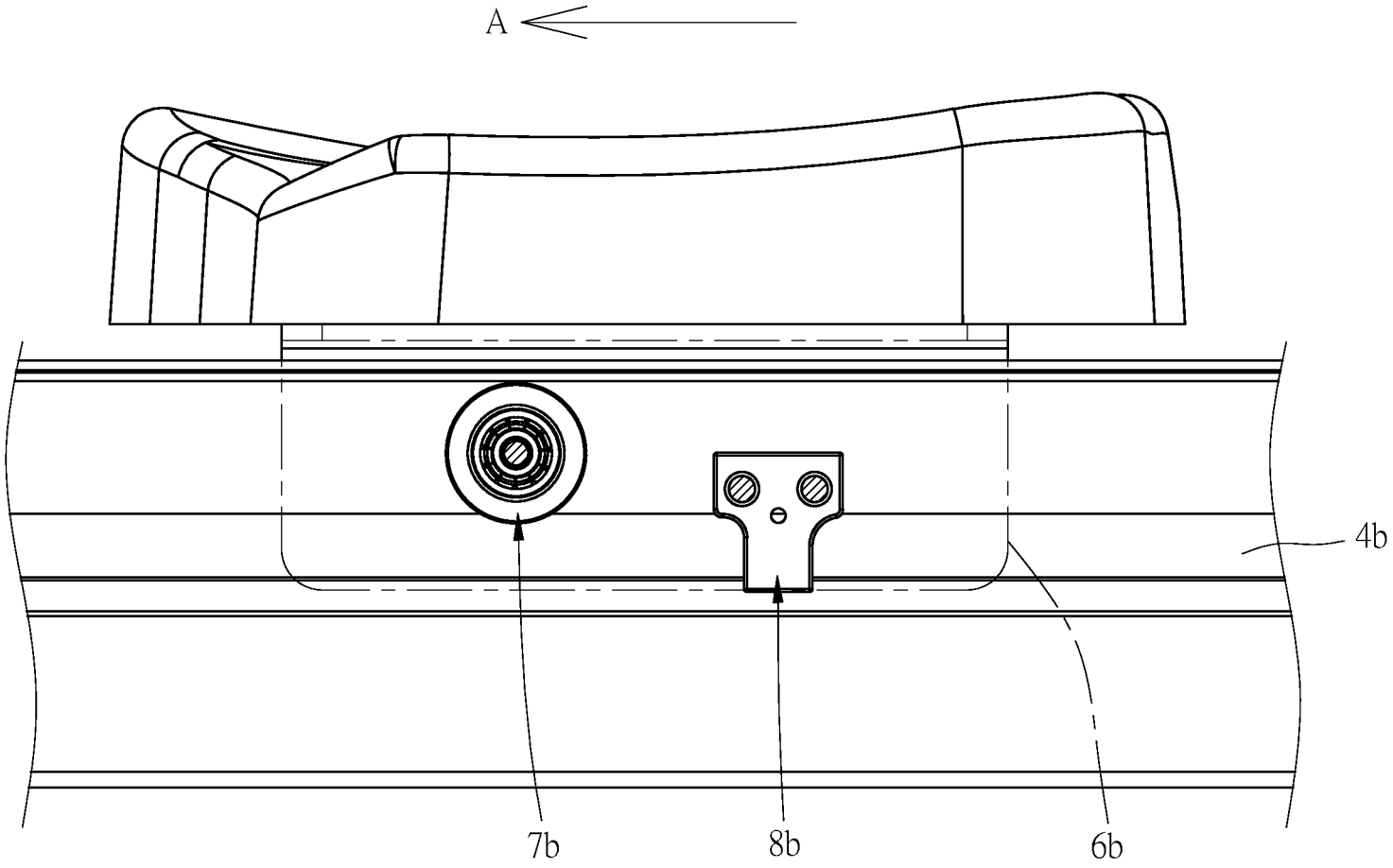
FIG. 11 is a side view of a third embodiment of the present invention.

FIG. 11 illustrates a third embodiment of the present invention. The third embodiment, viewed from the left side of the slide seat 6*b*, includes one dry-running limit slider 8*b* and one roller 7*b*.

Similar to the first embodiment, in the third embodiment, the slide seat 6*b* moves smoothly on the slide rail 4*b* along the axial direction A. The other structures and functions are the same as those of the first embodiment, so they are not repeated hereinafter, and the rest of the structure of the exercise machine is not shown in the drawings.

Figure 12:
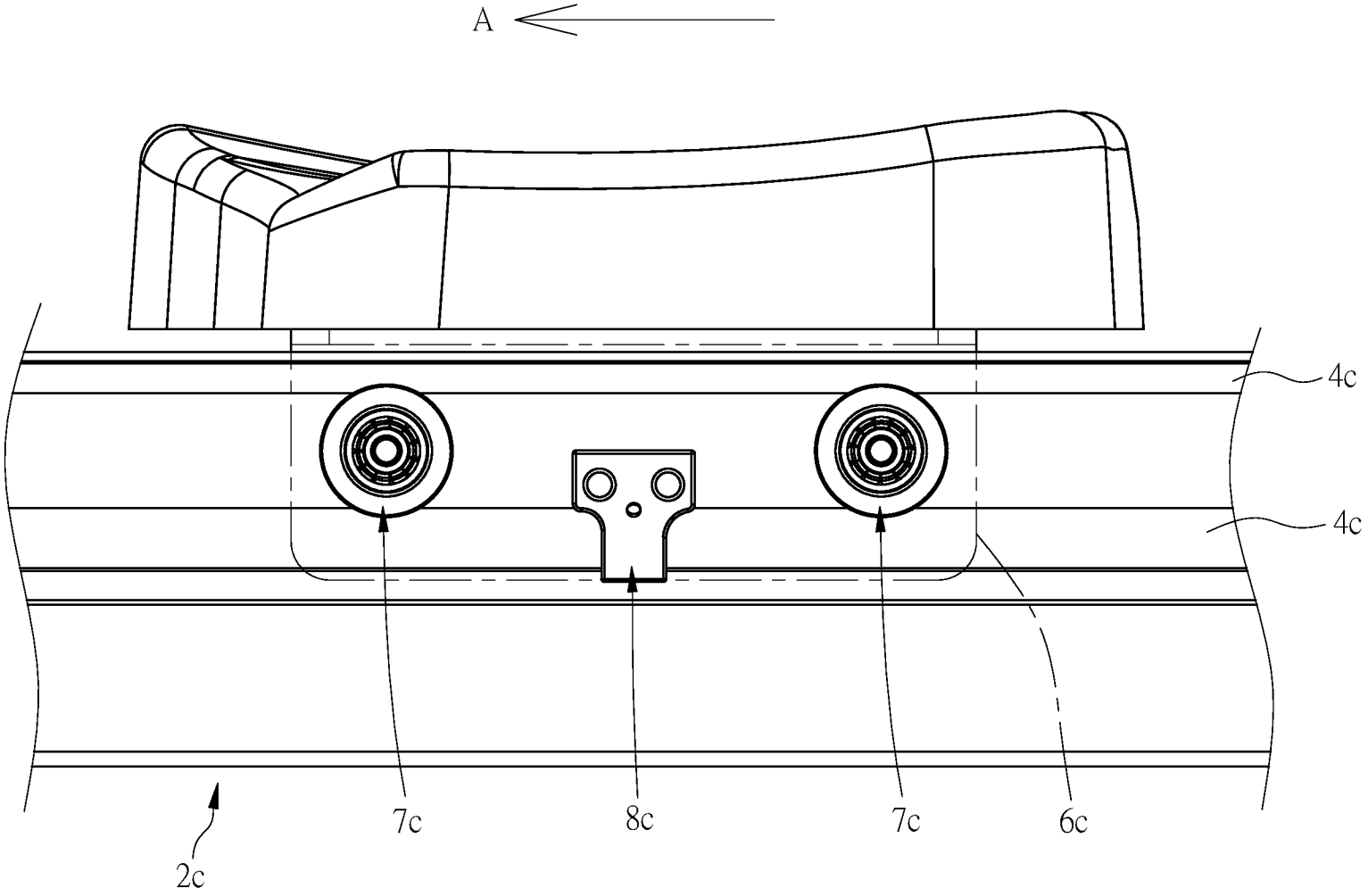
FIG. 12 is a side view of a fourth embodiment of the present invention.
Figure 13:
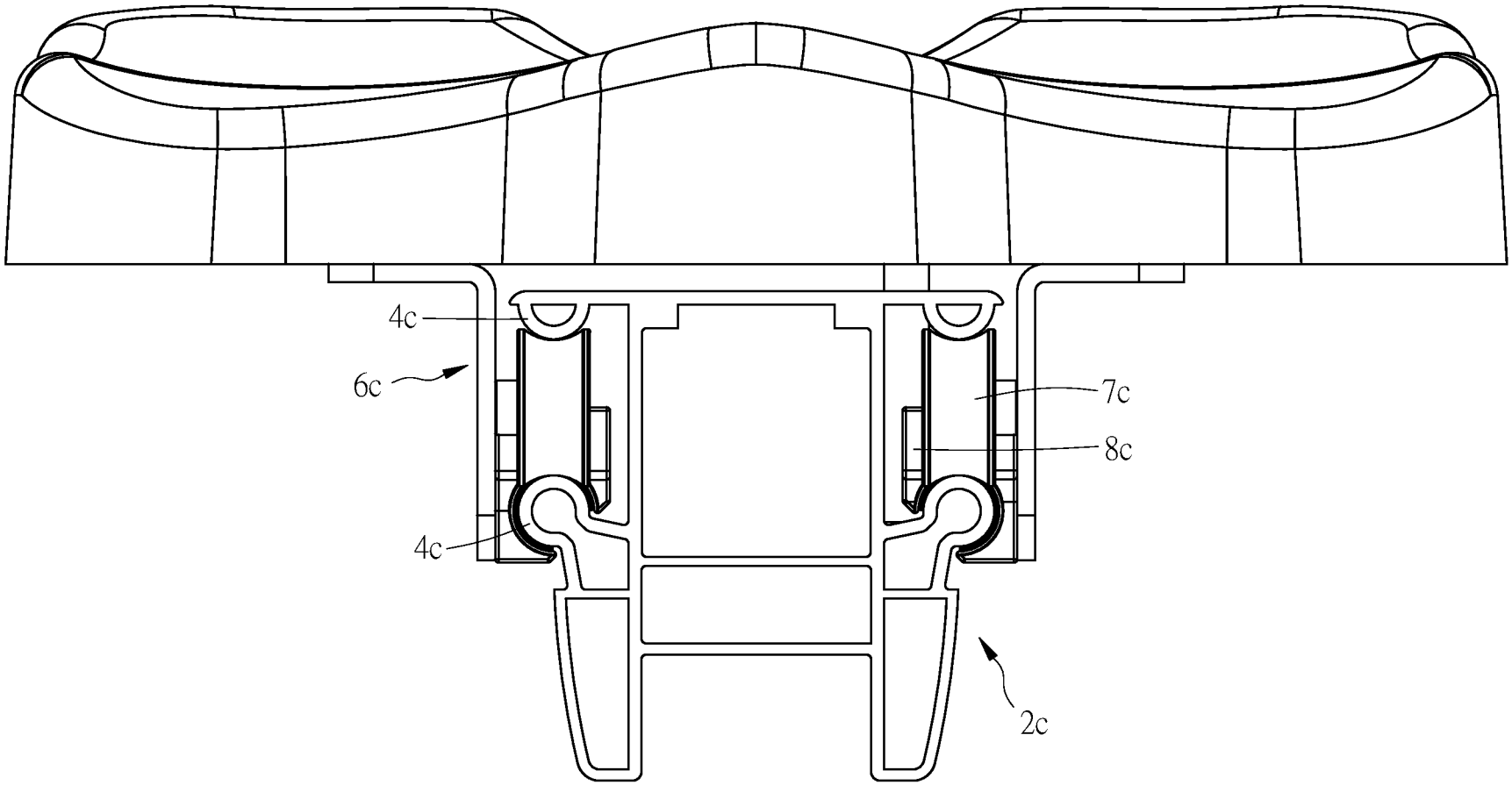
FIG. 13 is a front view of the fourth embodiment of the present invention.

FIG. 12 and FIG. 13 illustrate a fourth embodiment of the present invention. Each of the left and right sides of the rail seat 2*c* is provided with two slide rails 4*c*. The shapes of the two slide rails 4*c* on the same side may be different.

As shown in FIG. 12 and FIG. 13, each of the left and right sides of the slide seat 6*c* is provided with two rollers 7*c* and one dry-running limit slider 8*c*. The dry-running limit slider 8*c* is located between the rollers 7*c*. As shown in FIG. 13, on the left and right sides of the slide seat 6*c*, the rollers 7*c* on each side are disposed between the two slide rails 4*c* on each side. The roller 7*c* is in complete contact with the lower slide rail 4*c*, and there is a slight gap between the roller 7*c* and the upper slide rail 4*c*. The upper slide rail 4*c* assists the roller 7*c* in moving along the axial direction A without interfering with the rolling of the roller 7*c* excessively. In actual implementation, the arrangement of the rollers 7*a*, 7*b* and the dry-running limit sliders 8*a*, 8*b* of the second embodiment (FIG. 10) and the third embodiment (FIG. 11) may be applied to the fourth embodiment. In the fourth embodiment, since each of the left and right sides of the slide seat 6*c* has only one dry-running limit slider 8*c*, the dry-running limit slider 8*c* is only coupled to the lower slide rail 4*c*. In actual implementation, each of the upper and lower slide rails 4*c* on each side may be coupled with the dry-running limiting slide 8*c*.

Please refer to FIG. 6, FIG. 10, FIG. 11 and FIG. 13. Regardless of the number and relative positions of the rollers 7, 7*a*, 7*b*, 7*c* and the dry-running limit sliders 8, 8*a*, 8*b*, 8*c*, even if either side of the rail seat 2, 2*c* is provided with one or two slide rails 4, 4*a*, 4*b*, 4*c*, the roller 7, 7*a*, 7*b*, 7*c* and the dry-running limit slider 8, 8*a*, 8*b*, 8*c* enable the slide seat 6, 6*a*, 6*b*, 6*c* to move along the axial direction A on the slide rail 4, 4*a*, 4*b*, 4*c* more stably and smoothly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A slide structure of an exercise machine for sliding on a slide rail of the exercise machine, the slide rail being disposed on a rail seat of the exercise machine through a connecting portion, the slide rail extending along an axial direction, the slide structure of the exercise machine comprising:

a slide seat, configured to be movable along the axial direction relative to the slide rail;

a roller, rotatably coupled to the slide seat, the roller rolling on the slide rail along the axial direction;

a dry-running limit slider, including a bushing seat and a dry-running bushing, the bushing seat being coupled to the slide seat, the dry-running bushing being fixed to the bushing seat, the dry-running bushing embracing the slide rail on a vertical plane perpendicular to the axial direction to limit displacement of the slide seat on the vertical plane, the dry-running limit slider sliding on the slide rail along the axial direction, the bushing seat having a groove extending along the axial direction and a notch communicating with the groove, the dry-running bushing has a dry-running bushing notch corresponding to the notch and extending along the axial direction, on the vertical plane, the connecting portion is located in the notch and the dry-running bushing notch, and the dry-running bushing is located in the groove;

wherein the slide seat moves on the slide rail along the axial direction through the roller to roll along the axial direction, the dry-running limit slider to slide along the axial direction, and the dry-running limit slider to limit the displacement of the slide seat on the vertical plane.

2. The slide structure of the exercise machine as claimed in claim 1, wherein the roller includes a plurality of rollers each rolling on the slide rail.

3. The slide structure of the exercise machine as claimed in claim 2, wherein in the axial direction, the dry-running limit slider is located between the rollers.

4. The slide structure of the exercise machine as claimed in claim 2, wherein the slide rail includes a plurality of slide rails, and the rollers roll on each of the slide rails, respectively.

5. The slide structure of the exercise machine as claimed in claim 1, wherein the dry-running limit slider includes a plurality of dry-running limit sliders each sliding on the slide rail.

6. The slide structure of the exercise machine as claimed in claim 5, wherein in the axial direction, the roller is located between the dry-running limit sliders.

7. The slide structure of the exercise machine as claimed in claim 5, wherein the slide rail includes a plurality of slide rails, and the dry-running limit sliders slide on each of the slide rails, respectively.

8. The slide structure of the exercise machine as claimed in claim 1, wherein on the vertical plane, a contact cross-section of the roller and the slide rail is in the shape of one of an arc, a reverse V and a truncated cone.

9. The slide structure of the exercise machine as claimed in claim 1, wherein the bushing seat has an annular groove communicating with the groove on the vertical plane, an engaging groove is disposed in the annular groove and extends away from the notch, an outer wall of the dry-running bushing is provided with a plurality of blocks arranged annularly and corresponding to the annular groove, and one of the blocks has an engaging protrusion engaged in the engaging groove.

10. A slide structure of an exercise machine for sliding on a slide rail of the exercise machine, the slide rail being disposed on a rail seat of the exercise machine through a connecting portion, the slide rail extending along an axial direction, the slide structure of the exercise machine comprising:

a slide seat, configured to be movable along the axial direction relative to the slide rail;

a dry-running limit slider, including a bushing seat and a dry-running bushing, the bushing seat being coupled to the slide seat, the dry-running bushing being fixed to the bushing seat, the dry-running bushing embracing the slide rail on a vertical plane perpendicular to the axial direction to limit displacement of the slide seat on the vertical plane, the dry-running limit slider sliding on the slide rail along the axial direction;

wherein the bushing seat has a groove extending along the axial direction and a notch communicating with the groove, the dry-running bushing has a dry-running bushing notch corresponding to the notch and extending along the axial direction, on the vertical plane, the connecting portion is located in the notch and the dry-running bushing notch, and the dry-running bushing is located in the groove; and wherein the slide seat moves on the slide rail along the axial direction through the dry-running limit slider to slide along the axial direction and the dry-running limit slider to limit the displacement of the slide seat on the vertical plane.

* * * * *